US009622001B2

(12) United States Patent
Westergaard et al.

(10) Patent No.: US 9,622,001 B2
(45) Date of Patent: Apr. 11, 2017

(54) METHOD OF REMOTELY FITTING A HEARING AID SYSTEM, A REMOTE HEARING AID FITTING SYSTEM AND A HEARING AID

(71) Applicant: Widex A/S, Lynge (DK)

(72) Inventors: Anders Westergaard, Herlev (DK); Svend Vitting Andersen, Humlebak (DK)

(73) Assignee: Widex A/S, Lynge (DK)

( * ) Notice: Subject to any disclaimer, the term of this patent is extended or adjusted under 35 U.S.C. 154(b) by 19 days.

(21) Appl. No.: 14/885,312

(22) Filed: Oct. 16, 2015

(65) Prior Publication Data

US 2016/0044425 A1 Feb. 11, 2016

Related U.S. Application Data

(63) Continuation-in-part of application No. PCT/EP2013/059858, filed on May 14, 2013.

(51) Int. Cl.
*H04R 25/00* (2006.01)

(52) U.S. Cl.
CPC ..... *H04R 25/558* (2013.01); *H04R 25/505* (2013.01); *H04R 25/70* (2013.01); *H04R 25/554* (2013.01); *H04R 2225/55* (2013.01); *H04R 2225/61* (2013.01)

(58) Field of Classification Search
USPC ..... 381/312
See application file for complete search history.

(56) References Cited

U.S. PATENT DOCUMENTS

| | | | | |
|---|---|---|---|---|
| 2002/0136365 | A1* | 9/2002 | D'Agri | H04R 25/70 379/52 |
| 2010/0020992 | A1* | 1/2010 | Flynn | H04R 25/70 381/314 |
| 2014/0149805 | A1 | 5/2014 | Michihata et al. | |

FOREIGN PATENT DOCUMENTS

| | | | |
|---|---|---|---|
| DE | 19600234 | A1 | 7/1997 |
| DE | 29905172 | U1 | 7/1999 |
| JP | 298-4649 | B1 | 11/1999 |
| JP | 2000-287299 | A | 10/2000 |
| WO | 00/57672 | A2 | 9/2000 |
| WO | 01/54458 | A2 | 7/2001 |
| WO | 2007/068243 | A1 | 6/2007 |
| WO | 2010/089419 | A1 | 8/2010 |
| WO | 2011/128462 | A2 | 10/2011 |
| WO | 2013/046734 | A1 | 4/2013 |
| WO | 2013/117214 | A1 | 8/2013 |

OTHER PUBLICATIONS

Communication from the Japanese Patent Office issued Oct. 4, 20165 in counterpart Japanese Patent Application No. 2016-513235.

Notification of Transmittal of International Search Report and the Written Opinion of the International Searching Authority, or the Declaration for PCT/EP2013/095858 dated Dec. 20, 2013.

* cited by examiner

*Primary Examiner* — Amir Etesam
(74) *Attorney, Agent, or Firm* — Sughrue Mion, PLLC

(57) ABSTRACT

A method of remote fitting a hearing aid system (102) adapted to avoid mal-functioning of the hearing aid system as a consequence of an interruption or failure of the remote connection during a remote fitting of the hearing aid system. A hearing aid fitting system adapted for such a method and a hearing aid adapted for such a method.

11 Claims, 1 Drawing Sheet

METHOD OF REMOTELY FITTING A HEARING AID SYSTEM, A REMOTE HEARING AID FITTING SYSTEM AND A HEARING AID

RELATED APPLICATIONS

The present application is a continuation-in-part of application PCT/EP2013059858, filed on 14 May 2013, in Europe, and published as WO 2014183779 A1.

BACKGROUND OF THE INVENTION

1. Field of the Invention

The present invention relates to a method of fitting a hearing aid system. The present invention also relates to a hearing aid fitting system. The invention further relates to a hearing aid.

Generally a hearing aid system according to the invention is understood as meaning any system which provides an output signal that can be perceived as an acoustic signal by a user or contributes to providing such an output signal, and which has means adapted to compensate for an individual hearing loss of the user or contribute to compensating for the hearing loss of the user. These systems may comprise hearing aids that can be worn on the body or on the head, in particular on or in the ear, or that can be fully or partially implanted. However, a device whose main aim is not to compensate for a hearing loss, for example a consumer electronic device (televisions, hi-fi systems, mobile phones, MP3 players etc.), may also be considered a hearing aid system, provided it has measures for compensating for an individual hearing loss.

Within the present context a hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, e.g. a smart phone, having software applications adapted to interact with other devices of the hearing aid system. Thus within the present context the term "hearing aid system device" may denote a hearing aid or an external device.

In a traditional hearing aid fitting procedure, the hearing aid user travels to an office of a hearing aid fitter, and the user's hearing aids are adjusted using the fitting equipment that the hearing aid fitter has in his office. Typically the fitting equipment comprises a computer capable of executing the relevant hearing aid programming software and a programming device adapted to provide a link between the computer and the hearing aid. This procedure is disadvantageous in cases where it is difficult or expensive for the hearing aid user to visit a hearing aid fitting office.

2. The Prior Art

Methods for remote fitting of hearing aids have been proposed in the art.

DE-A1-19600234 discloses a method of fitting a hearing aid, wherein data are transmitted from the fitting equipment and to the hearing aid using a remote data transmission link, such that the hearing aid fitting can be carried out practically independent on the distance between the hearing aid user and the hearing aid fitter. In one embodiment the system comprises two computers that are connected using an ISDN link and in another embodiment one of the two computers comprises means for transforming the data, received over the transmission link, into a data format that can be understood by the hearing aid.

DE-U1-29905172 discloses a programming device that can be coupled directly to a telephone line, a modem or a computer, whereby data can be transmitted to and from the programming device. The programming device is adapted to access and adjust the setting of a hearing aid. In this way the hearing aid fitter can adjust the setting of a distant hearing aid using the programming device and a telephone line for providing the data transmission link between the programming device and the fitting software located within the hearing aid fitter's office.

WO-A2-2011/128462 discloses a method for providing distant support to a plurality of personal hearing aid users. Prior to a support session, users are paired with providers by storing a pairing information, and when starting a support session, the stored pairing information is used to determine a support provider. According to an embodiment, data exchanged between the user computer and the supporter computer are relayed by a relay server, whereby both user and support provider may be located behind a firewall.

None of the prior art addresses what will happen in case of a failure of the remote link means, i.e. the internet connection, during a remote fitting session. There is a significant risk that the hearing aid user will be left with a non-functional hearing aid, because some, but not all, relevant hearing aid parameters and settings have been reprogrammed and therefore may result in a hearing aid with incompatible data settings.

It is therefore a feature of the present invention to provide a method of remote fitting a hearing aid system that despite a possible failure or interruption of the remote connection will not leave the hearing aid user with a non-functional hearing aid.

It is yet another feature of the present invention to provide a method of remote fitting a hearing aid system that can keep the hearing user informed of possible issues with the remote connection.

It is another feature of the present invention to provide a hearing aid system that is adapted to avoid mal-functioning as a consequence of failure of the remote connection during a remote fitting session of the hearing aid system.

It is yet another feature of the present invention to provide a hearing aid system that is adapted to avoid mal-functioning as a consequence of failure of the remote connection during a remote fitting session of the hearing aid system.

It is still another feature of the present invention to provide an improved remote hearing aid fitting system.

SUMMARY OF THE INVENTION

The invention, in a first aspect, provides a method of remotely fitting a hearing aid system comprising the steps of providing a hardware client holding a hearing aid fitting software; in a hearing aid of said hearing aid system, providing a first memory comprising a first set of sound processing parameters adapted to control a signal processor for processing audio signals in order to alleviate a hearing deficit of an individual hearing aid user; in said hearing aid, providing a second memory comprising a copy of said first set of sound processing parameters; operationally connecting a hearing aid system and the hearing aid fitting software using a long range data connection, hereby initiating a remote hearing aid fitting session; altering at least one sound processing parameter in one of said first and said second memory in response to a command provided from said hearing aid fitting software, hereby providing a second set of sound processing parameters; activating a counter in said hearing aid in response to a first command provided from said hearing aid fitting software; resetting said counter in response to a second command provided from said hearing aid fitting software; and in response to said counter exceeding a first predetermined threshold value: shutting down any remote hearing aid fitting processes and restoring said first set of sound processing parameters, hereby terminating the remote hearing aid fitting session and resuming normal hearing aid operation.

This provides an improved method of remote fitting a hearing aid system that may avoid the risk of leaving the user with a non-functional hearing aid system as a consequence of failure of the remote connection during a remote fitting session of the hearing aid system.

The invention, in a second aspect, provides a remote hearing aid fitting system comprising a first hardware client holding hearing aid fitting software; an external device operationally connected to said first hardware client and operationally connected to a hearing aid; wherein said external device is adapted to read current sound processing parameters from said hearing aid and to store said sound processing parameters in a memory of said external device in response to a command from the hearing aid software; and wherein said external device further comprises a trigger adapted to provide, in response to meeting a trigger condition, that remote fitting processes in the hearing aid are shut down, the sound processing parameters stored in a memory of the external device are used to restore the hearing aid sound processing parameters; and that a remote hearing aid fitting session is terminated and normal hearing aid operation is resumed.

This provides an improved remote hearing aid fitting system.

The invention, in a third aspect, provides a hearing aid comprising a first memory comprising a first set of sound processing parameters adapted to control a signal processor for processing audio signals; a second memory comprising a copy of said first set of sound processing parameters; link means adapted to provide an operational connection between the hearing aid and a remote hearing aid fitting software, whereby a remote hearing aid fitting session is initiated; a counter adapted to be activated in response to a first command provided from said remote hearing aid fitting software, adapted to be reset in response to a second command provided from said remote hearing aid fitting software, and adapted to be deactivated in response to a third command provided from said remote hearing aid fitting software; programming means adapted to alter at least one sound processing parameter in said first or second memory in response to a fourth command provided from said remote hearing aid fitting software using said link means hereby providing a second set of sound processing parameters; and a trigger adapted to provide, in response to the counter exceeding a first predetermined threshold value, that the first set of sound processing parameters is restored in said first and second memory, that remote fitting processes in the hearing aid are shut down, that the hearing aid fitting session is terminated and that normal hearing aid operation is resumed.

This provides an improved a hearing aid that is adapted to avoid mal-functioning as a consequence of failure of the remote connection during a remote fitting session of the hearing aid.

Further advantageous features appear from the dependent claims.

Still other features of the present invention will become apparent to those skilled in the art from the following description wherein embodiments of the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

In the present context a remote hearing aid fitting session is to be understood as a hearing aid fitting session wherein the hearing aid user is separated from the hearing aid fitter by such a distance that it is not possible for the hearing aid fitter to directly (i.e. by being in the same room) assist the hearing aid user in manually operating the hearing aid system. Therefore it presents a critical problem in a remote fitting session if the data connection between the hearing aid user and the hearing aid fitter is interrupted.

Figure 1:
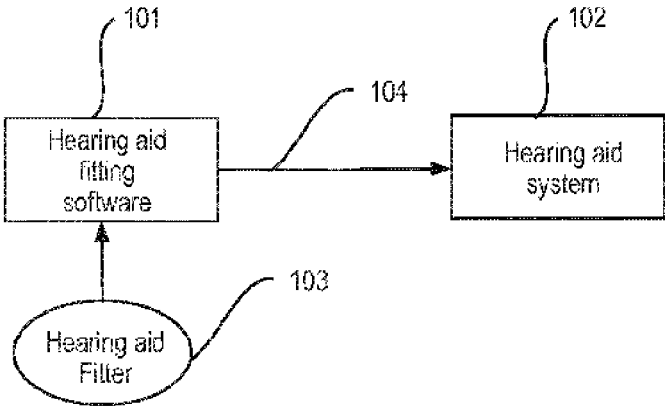
FIG. 1 illustrates highly schematically a hearing aid fitting system according to an embodiment of the invention.

Reference is first made to FIG. 1, which illustrates highly schematically a remote hearing aid fitting set-up according to an embodiment of the invention. The set-up comprises hearing aid fitting software 101 that is operationally connected to a remote hearing aid system 102 using remote link means capable of transmitting a fitting signal 104 from the hearing aid fitting software 101 and to the hearing aid system 102. In the present embodiment the operational connection is over the internet. A hearing aid fitter 103 controls the hearing aid fitting software 101. In the present embodiment the hearing aid software is installed on a personal computer.

Figure 2:
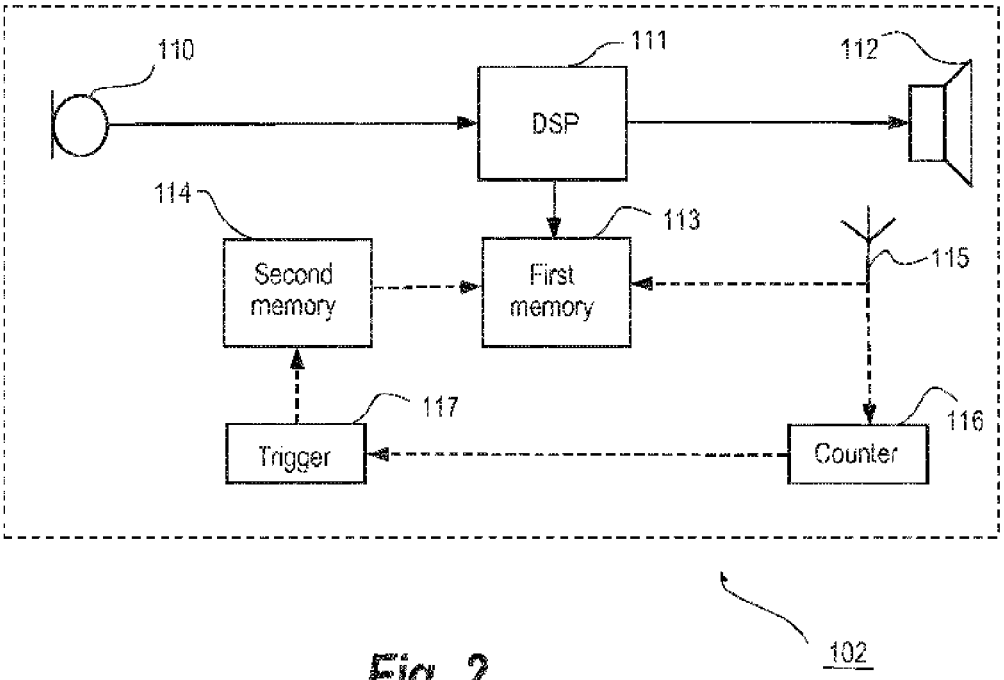
FIG. 2 illustrates highly schematically selected parts of a hearing aid system according to an embodiment of the invention.

Reference is now made to FIG. 2, which illustrates highly schematically a hearing aid system 102 according to an embodiment of the invention, consisting of a single hearing aid comprising an acoustical-electrical input transducer 110 in the form of microphone, a digital signal processor 111 adapted for alleviating a hearing deficit of an individual hearing aid user, an electrical-acoustical output transducer 112 in the form of a loudspeaker, a first memory 113 holding a first set of sound processing parameters, adapted to control the signal processor 111, a second memory 114 also holding said first set of sound processing parameters, wireless link means 115 adapted to operationally connect the hearing aid system 102 with the remote hearing aid fitter software 101 over the internet, a digital counter 116 and a trigger 117 adapted for transferring the data in said second memory to said first memory and hereby replacing the data in said first memory with the data from said second memory in response to a detection of the trigger condition that the value of the digital counter 116 has exceeded a predetermined threshold value.

The digital counter 116 is adapted to be activated by a command from the hearing aid software 101 when a remote fitting session is initiated and adapted to be deactivated by a command from the hearing aid software 101 when a remote hearing aid fitting session has finished. The hearing aid software can determine that the hearing aid fitting session has finished in variety of ways, including e.g. evaluating a check-sum received from the hearing aid or by simply reading out the new sound processing parameters stored in the hearing aid memories.

Furthermore the digital counter 116 is adapted to receive a reset command from the hearing aid software over the wireless link means 115. The hearing aid fitting software is adapted to transmit a reset command with regular intervals during the remote fitting session. Thus if the internet connection for some reason is interrupted, the digital counter 116 will not be reset, and after a short while, the trigger condition will be met and the sound processing parameters in the first memory 113 will be replaced by the sound processing parameters from the second memory, hereby ensuring that the set of sound processing parameters used to control the signal processor 111 is always an operational set, something which might not have been the case if the internet connection had been interrupted before a remote fitting session had finished. Finally the hearing aid will also return to normal operation mode and shut down any remote fitting processes in response to meeting said trigger condition. Thus in the present context normal operation mode may be understood as any operation mode where remote fitting mode is not carried out and where the hearing aid can alleviate a hearing deficit of an individual hearing aid user.

According to the FIG. 2 embodiment the predetermined threshold value is set to represent a time period of 15 seconds. In variations, the time period that the threshold value represents may be in the range between 5 seconds and 10 minutes. According to a specific variation the current threshold value may be altered dynamically during the remote fitting session whereby e.g. the duration of the remote fitting processes can be taken into account when determining the current threshold value, such that the threshold value is increased if the duration of a specific fitting process, such as a feedback test, is expected to be significantly longer than the time period that the normal threshold value represents. In this way it is avoided to send reset commands in a period where a possible (short) interruption of the internet connection will not have a detrimental impact on the remote fitting.

Hereby, according to the FIG. 2 embodiments and its variations, in case the internet connection is interrupted, the hearing aid user will never need to wait longer than the time period represented by the predetermined threshold value, i.e. in the range between 5 seconds and 10 minutes, before the hearing aid system 102 returns to normal operation mode.

According to the FIG. 2 embodiment a specific reset command is transmitted from the hearing aid fitting software with regular intervals corresponding to the predetermined threshold value of 15 seconds. In variations the duration of the interval for resetting the counter depends on the current threshold value and is set in the range of 1 second to 60 seconds.

According to further variations of the FIG. 2 embodiment, no specific reset commands are transmitted, instead the counter is reset each time data is received from the remote fitting software or each time the hearing aid is transmitting a receipt in response to receiving data from the remote hearing aid fitting software. In this manner no extra bandwidth is required to reset the counter.

According to a variation of the FIG. 2 embodiment, the hearing aid system 102 is adapted to change the sound processing parameters held in the second memory 114 instead of changing the corresponding parameters in the first memory 113 (as it is done in the original FIG. 2 embodiment) in response to receiving remote fitting commands from the hearing aid fitting software 101, and further adapted to replace the sound processing parameters held in the first memory 113 with the new sound processing parameters held in the second memory 114 and subsequently resume normal operation in response to a command indicating that the remote fitting has finished.

According to further variations of the preceding embodiments of FIG. 2 the hearing aid system 102 is adapted to resume normal operation in response to the trigger condition being met. According to still further variations the hearing aid system 102 may be adapted to alert the hearing user that the remote fitting has been interrupted.

According to still further variations of the preceding embodiments of FIG. 2, the hearing aid fitting software 101 and the hearing aid system 102 are adapted to allow a typical response time for the communication over the internet to be measured, which can be done using methods well known in the art of data communication based on considering the timing of transmitted commands and the corresponding received receipts, and based hereon determining a threshold value for the trigger. Hereby a remote fitting can be carried out without undesired resets, even if the internet connection is so slow that the remote hearing aid fitting system would otherwise have assumed the connection to be interrupted.

According to another variation of the preceding embodiments of FIG. 2, the hearing aid system 102 is adapted such that a multitude of predetermined threshold values and hereby trigger conditions are set, wherein the effects of meeting the various trigger conditions are different. According to a specific embodiment of this variation of the preceding embodiments, an acoustic alert informing the hearing aid user that: "the internet connection is slow or interrupted" is provided when the first predetermined threshold value has been exceeded. If the second predetermined threshold value is also exceeded, the hearing aid provides the hearing aid user with an acoustic alert informing that: "the internet connection has been interrupted in one minute, if the connection is not recovered in 30 seconds, the remote fitting session will be interrupted and normal hearing aid operation resumed".

If a third predetermined threshold value is also exceeded, the hearing aid interrupts the remote fitting, resumes normal operation and provides the hearing aid user with an acoustic alert informing that: "the remote fitting session has been interrupted due to an interrupted internet connection and normal hearing aid operation is resumed. Please retry remote fitting later using this same connection or possibly using another internet connection". Thus according to this embodiment a multitude of specific acoustic alerts or messages are stored in the hearing aid and selectively activated when a corresponding specific threshold value is exceeded by the counter 116.

According to yet another and more advanced variation of the preceding embodiments of FIG. 2, the hearing aid fitting software 101 and the hearing aid system 102 are adapted such that the hearing aid fitting software 101 can provide the hearing aid system 102 with commands that trigger a specific acoustic alert, stored in the hearing aid system, informing the hearing aid user that a certain part of the remote fitting has finished, e.g.: "feedback test has been carried out successfully", or providing the hearing aid user with an estimate of the time remaining before the remote fitting has finished, e.g.: "the remote fitting will be finished in approximately three minutes".

According to another variation the remote fitting is carried out using a remote hearing aid fitting system comprising an external device that is operationally connected to the fitting software over the internet and operationally connected to the hearing aid system using a short range wireless link such that fitting commands from the distant hearing fitting software are transmitted to the hearing aid system via the external device. In a specifically advantageous variation the external device is adapted to read out the current sound processing parameters from the hearing aid system and store them in a memory in the external device, and adapted to reset the hearing aid system by programming the hearing aid system with said stored sound processing parameters and setting the hearing aid system in normal operation mode in response to a given trigger event. The trigger event may be that a counter in the external device exceeds a predetermined threshold, as has been disclosed in the preceding variations, but it may also be that the external device additionally comprises a manual actuator that the user can activate in order to trigger the reset of the hearing aid system. This variation is especially advantageous in that a remote fitting with automatic reset of the hearing aid system in case of an interruption of the remote data link can be ensured without requiring any added functionality of the hearing aid system.

According to a further variation the remote hearing aid fitting system comprising the external device may be implemented as disclosed with reference to FIG. 1 in PCT application PCT/EP2012/052000 filed in Europe on 7 Feb. 2012 and published as WO-A1-2013117214.

According to an alternative variation the remote hearing aid fitting system comprising the external device may be implemented by using a smart phone or similar device as the external device.

Thus according to the various embodiments of the invention the trigger and the digital counter may be accommodated in the hearing aid system or in an external device, operationally connected with the hearing aid system using a short range link and operationally connected with the hearing aid fitting software using a long range link, which is typically the internet. The long range link may also be denoted a long range data connection. The short range link may be a short-range wireless communication link but it may also be a wired connection.

The various implementations of the trigger conditions and the effects thereof may be implemented in any of the apparatus embodiments. Further it may be selected to accommodate the counter, the trigger and the memories for storage of the sound processing parameters and sound alerts in either the hearing aid system or the external device, or it may even be selected to have these means distributed between these devices.

In the present context the step of shutting down any fitting processes is to be construed to mean that the hearing aid is brought into a mode of operation, wherefrom normal mode of operation can be resumed despite that the fitting session has not finished in the way it should have. Methods for implementing that any fitting processes are shut down will be obvious for a person skilled in the art. It is not required that any fitting processes are in fact shut down, it may as well be that a subsequent fitting process has not started, as it should have, and therefore that normal mode of operation can be resumed without shutting down any fitting processes. However, it may also be that a fitting process is stuck in a loop and awaits a fitting command from the remote fitting software, in which case the fitting process needs to be shut down, which can be done in ways that will be obvious for a person skilled in the art.

According to variations the remote fitting session and the corresponding commands from the remote hearing aid fitting software are designed such that a fitting process that is initiated in the hearing aid can finish without requiring further instructions from the remote hearing aid fitting software, in which case the step of shutting down any fitting processes may not be required. However, fitting processes may need to be shut down for other reasons than an interrupted connection between the hearing aid and the remote hearing aid fitting software, and therefore the step may be included anyway according to other variations.

Common for all embodiments and variations according to the invention is that normal mode of operation of the hearing aid is automatically resumed in case the internet connection between the hearing aid and the remote hearing aid fitting software is interrupted.

We claim:

1. A method of remotely fitting a hearing aid system comprising the steps of:

providing a hardware client holding a hearing aid fitting software;

in a hearing aid of said hearing aid system, providing a first memory comprising a first set of sound processing parameters adapted to control a signal processor for processing audio signals in order to alleviate a hearing deficit of an individual hearing aid user;

in said hearing aid, providing a second memory comprising a copy of said first set of sound processing parameters;

operationally connecting a hearing aid system and the hearing aid fitting software using a long range data connection, hereby initiating a remote hearing aid fitting session;

altering at least one sound processing parameter in one of said first and said second memory in response to a command provided from said hearing aid fitting software, hereby providing a second set of sound processing parameters;

activating a counter in said hearing aid in response to a first command provided from said hearing aid fitting software;

resetting said counter in response to a second command provided from said hearing aid fitting software; and in response to said counter exceeding a first predetermined threshold value: shutting down any remote hearing aid fitting processes and restoring said first set of sound processing parameters, hereby terminating the remote hearing aid fitting session and resuming normal hearing aid operation.

2. The method according to claim 1, wherein said predetermined threshold value represents a time interval in the range between 2 seconds and 10 minutes.

3. The method according to claim 1, wherein said altering step comprises altering at least one sound processing parameter in said first memory hereby providing the second set of sound processing parameters in said first memory; and wherein the step in response to said counter exceeding said first predetermined threshold value comprises replacing said second set of sound processing parameters in said first memory with said first set of sound processing parameters in said second memory.

4. The method according to claim 1, wherein said altering step comprises altering a sound processing parameter in said second memory hereby providing a second set of sound processing parameters in said second memory; and comprising the further step of:

replacing said first set of sound processing parameters in said first memory with said second set of sound processing parameters in said second memory in response to an indication that the remote fitting session has finished.

5. The method according to claim 4, wherein said indication that the remote fitting session has finished is provided as a command from the hearing aid fitting software.

6. The method according to claim 1 comprising the further steps of:

providing at least two distinct predetermined threshold values;

triggering the hearing aid to provide a specific effect dependent on the specific threshold value, out of said predetermined values.

7. The method according to claim 1, comprising triggering the hearing aid to provide an audible alert in response to said counter exceeding a given predetermined threshold value.

8. The method according to claim 1, comprising deactivating said counter in response to receiving a command from the hearing aid fitting software that the remote fitting session has finished.

9. A hearing aid comprising:

a first memory comprising a first set of sound processing parameters adapted to control a signal processor for processing audio signals;

a second memory comprising a copy of said first set of sound processing parameters;

link means adapted to provide an operational connection between the hearing aid and a remote hearing aid fitting software, whereby a remote hearing aid fitting session is initiated;

a counter adapted to be activated in response to a first command provided from said remote hearing aid fitting software, adapted to be reset in response to a second command provided from said remote hearing aid fitting software, and adapted to be deactivated in response to a third command provided from said remote hearing aid fitting software;

programming means adapted to alter at least one sound processing parameter in said first or second memory in response to a fourth command provided from said remote hearing aid fitting software using said link means hereby providing a second set of sound processing parameters; and a trigger adapted to provide, in response to the counter exceeding a first predetermined threshold value, that the first set of sound processing parameters is restored in said first and second memory, that remote fitting processes in the hearing aid are shut down, that the hearing aid fitting session is terminated and that normal hearing aid operation is resumed.

10. The hearing aid according to claim 9, wherein said trigger is further adapted to provide at least two distinct predetermined threshold values and to provide a specific effect dependent on the specific threshold value, out of said predetermined values.

11. The hearing aid according to claim 9, comprising:

a third memory storing at least two data packages adapted to provide an audible alert, wherein said trigger is further adapted to select from said memory a specific audible alert in response to said counter exceeding a specific predetermined threshold value.

* * * * *